United States Patent [19]

Boyes et al.

[11] Patent Number: 4,733,825

[45] Date of Patent: Mar. 29, 1988

[54] CENTRIFUGAL GRINDING MILLS

[75] Inventors: John M. Boyes; William R. Rayner; Charles H. Warman, all of Sydney, Australia

[73] Assignee: Research and Development Party Ltd., North Sydney, Australia

[21] Appl. No.: 758,424

[22] Filed: Jul. 24, 1985

[30] Foreign Application Priority Data

Jul. 24, 1984 [AU] Australia ..... PG6185

[51] Int. Cl.[4] ..... B02C 17/14

[52] U.S. Cl. ..... 241/19; 241/57; 241/69; 241/175; 241/179

[58] Field of Search ..... 241/175, 79.1, 171, 241/80, 97, 179, 19, 24, 48, 52, 53, 57, 69, 18, 26

[56] References Cited

U.S. PATENT DOCUMENTS

| | | | |
|---|---|---|---|
| 2,500,908 | 3/1950 | Symons | 241/175 X |
| 2,778,577 | 1/1957 | Linke | 241/175 X |
| 3,042,322 | 7/1962 | Symons | 241/175 |
| 3,084,876 | 4/1963 | Podmore | 241/175 X |
| 3,552,660 | 1/1971 | Hamaker . | |
| 4,047,672 | 9/1977 | Volkov et al. | 241/175 |
| 4,095,753 | 6/1978 | Ohno . | |

FOREIGN PATENT DOCUMENTS

| | | | |
|---|---|---|---|
| 881600 | 7/1953 | Fed. Rep. of Germany | 241/175 |

*Primary Examiner*—Mark Rosenbaum

*Attorney, Agent, or Firm*—Cushman, Darby & Cushman

[57] ABSTRACT

A centrifugal grinding mill including a grinding chamber of substantially circular cross-section with respect to an axis of symmetry and constrained to have nutating motion about a relatively stationary axis, a support for supporting the grinding chamber, a feed passage in communication with the grinding chamber, a driving assembly for driving the grinding chamber about the relatively stationary axis, and a constraint assembly for determining the form of nutating motion of the axis symmetry of the grinding chamber. The nutating motion of the grinding chamber during operation of the grinding mill causes a grinding charge carried in the grinding chamber to dilate and perform a tumbling motion within the grinding chamber. Further, the grinding chamber has a surface configured to exert pressure on the grinding charge so as to limit its dilation and provide effective containment of the grinding charge.

21 Claims, 9 Drawing Figures

CENTRIFUGAL GRINDING MILLS

This invention relates to grinding mills of the kind which perform the size reduction of solid particles by the action of loose grinding media.

A commonplace method of comminuting solid particles—for example those of mineral ores—utilizes a grinding chamber of cylindrical or cylindro-conical shape disposed and revolving about a horizontal axis and partially filled with loose grinding media which break the particles as they pass through the chamber. Mills of this type are generically termed "tumbling mills." The grinding media may comprise manufactured shapes of steel or other material or may simply be a coarse component of the feed substance when the process is known as autogeneous grinding.

It is characteristic of tumbling mills that the specific power input achievable is inherently limited by gravitational acceleration and is typically less than 20 kilowatts per cubic meter of grinding chamber volume. The grinding capacity per unit grinding chamber volume is consequently low.

In comparison to tumbling mill performance the specific power input and grinding rate can be substantially increased by gyrating the grinding chamber, usually in a circular path, about a fixed axis. In this manner the grinding chamber and its contents may be subjected to accelerations much greater than gravity according to the relationship—

$$\text{acceleration} \propto w^2 r$$

where w is the angular velocity and r is the radius of gyration. Grinding mills operating on this principle are described by the generic terms "vibration mills" and "centrifugal mills," the term vibration mill generally being applied where the radius r is very small compared with the diameter or suchlike typical dimension of the grinding chamber. According to convention the ratio of gyration radius to grinding chamber diameter typically is less than 0.05 for vibration mills and is in the range 0.15 to 0.5 for centrifugal mills.

Specific power inputs up to 500 kilowatts per cubic meter of grinding chamber volume have been achieved with centrifugal mills, the grinding capacity per unit volume being correspondingly increased. Such mills however are not in widespread industrial use primarily because they have mechanical, geometrical, feed and/or discharge characteristics hich offset the potential advantages of their use.

It is an object of the present invention to provide a centrifugal grinding mill in which at least some of the aforementioned disadvantages associated with conventional grinding mills are at least diminished.

This invention embodies a centrifugal mill having a grinding chamber substantially symmetrical about an axis which moves and is constrained to generate a conical surface of revolution about a relatively stationary axis, all cross-sections of the grinding chamber normal to its axis of symmetry being substantially circular and typically of increasing radius from the feed opening (situated nearest to the intersection of the chamber axis with the axis of revolution) towards the discharge grate situated furthest from said intersection. Typically the sides of the chamber between the feed opening and the discharge grate form the frustum of a cone with vertex in the vicinity of the point of intersection of the chamber axis with the axis of revolution. Typically the inner surface of the discharge grate is concave and peripherally normal to the conical surface of the chamber.

The motion of the grinding chamber above described is throughout this specification referred to as a motion of nutation in contra-distinction to the gyratory motion of the centrifugal mills of prior art in which the axis of the grinding chamber is constrained to be substantially parallel to the axis of revolution. Whilst the axis of revolution of the nutating grinding mill could have virtually any orientation from horizontal to vertical, significant advantages in the feeding and discharging of the mill accrue from having the axis of revolution vertical with the feed entering the mill vertically downward, and all the embodiments herein described have such orientation.

The nutating motion above described confers significant advantages over gyratory motion for centrifugal mills as will become more evident from some specific forms of the invention illustrated in the accompanying drawings wherein like parts are illustrated by like characters. Further to indicate clearly the function of the various component parts illustrated in FIGS. 1 through 7, rotating members are marked with closely spaced hatching, nutating members are marked with widely spaced hatching and stationary members are marked with the widest spacing.

Figure 1:
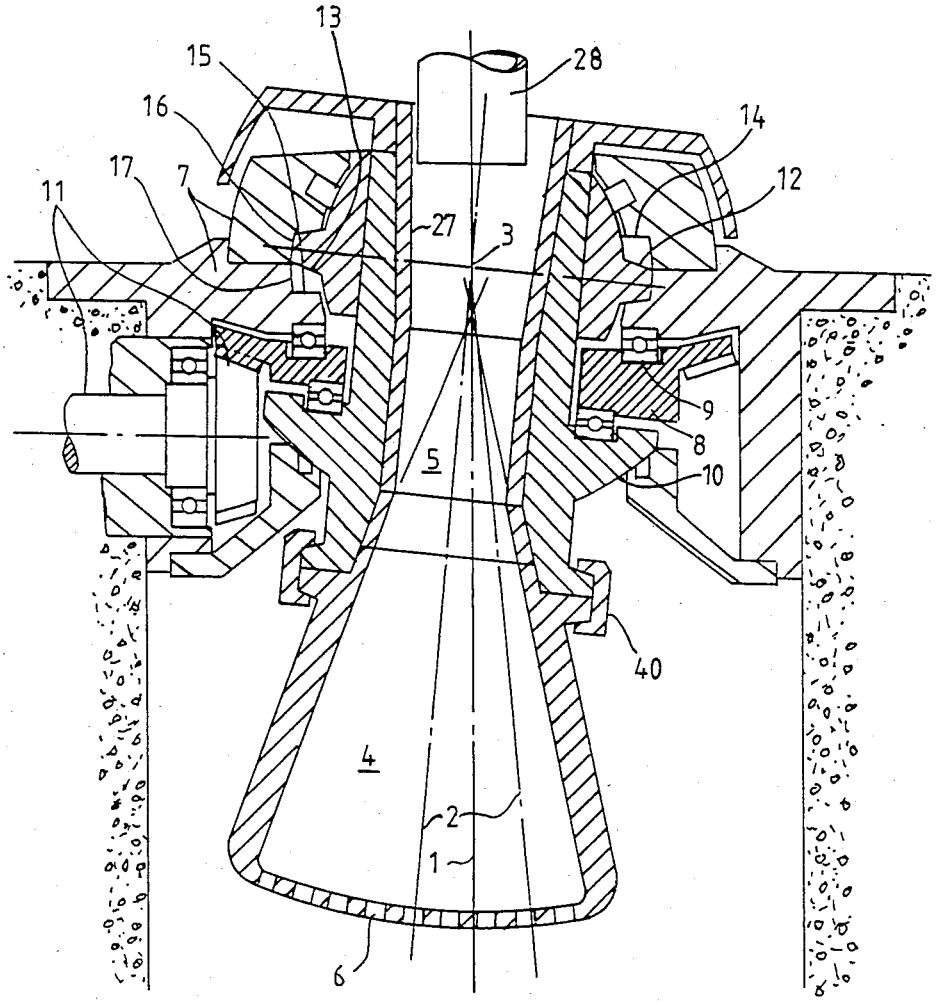
FIG. 1 is a cross-sectional view of a grinding mill formed in accordance with the present invention taken through its axis of revolution.

Each of the variant forms illustrated in the drawings is characterized by having a vertical axis of revolution 1, a nutating axis 2 intersecting axis 1 at point of nutation 3, a nutating grinding chamber 4 and a nutating feed passage 5 symmetrical about axis 2, a discharge grate 6, and support means comprising frame member of members 7 adapted to support the mill and/or to secure it and to transmit forces and moments generated by its operation to suitable foundations.

Figure 2:
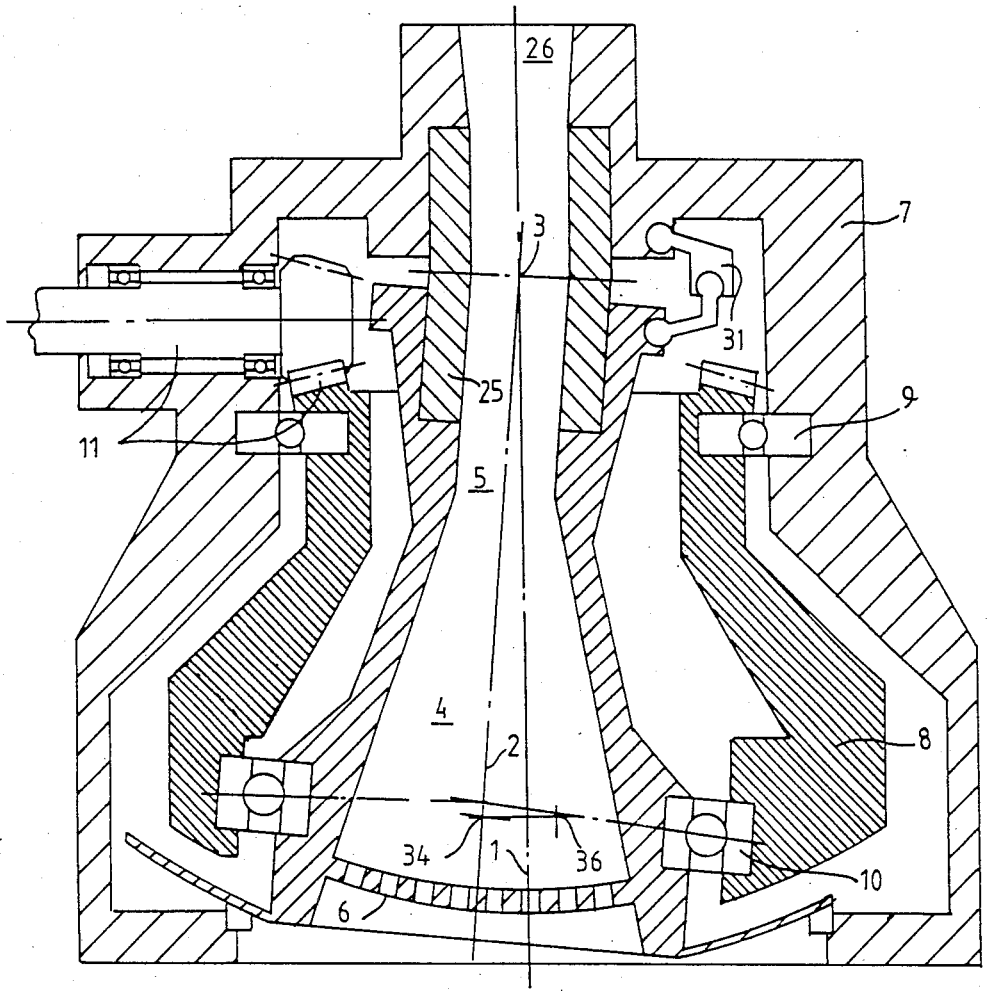
FIG. 2 is a cross-sectional view of another embodiment of a grinding mill formed in accordance with the present invention.
Figure 3:
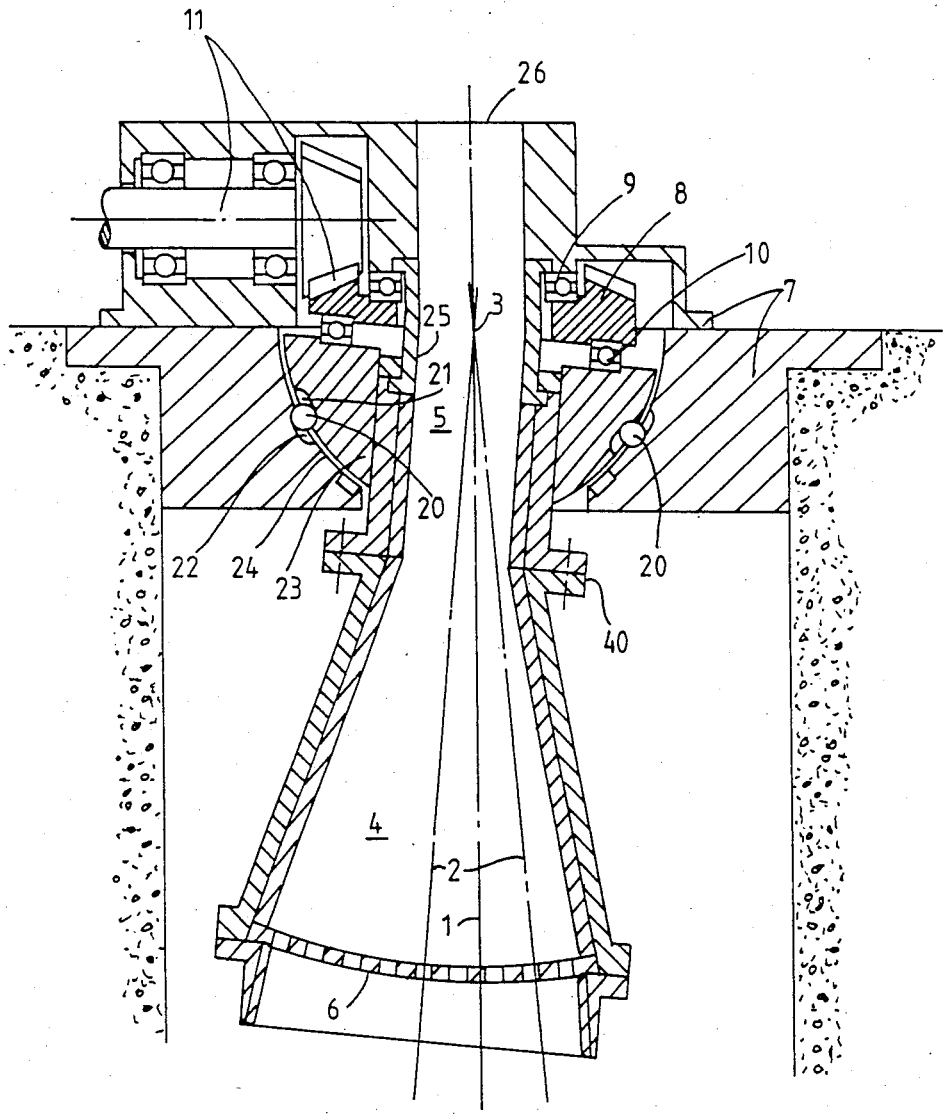
FIG. 3 is a cross-sectional view of yet another embodiment of the present invention.

Each of the variant forms illustrated in FIGS. 1, 2 and 3 is characterized by having a member 8 located in frame member 7 for rotation about the vertical axis 1 by a bearing 9 and driving the nutating members through a bearing 10 mounted on said members symmetrically about the nutating axis 2, said member 8 being rotated by any suitable means such as the bevel gearing and belt driven countershaft depicted at 11. In the variant form of FIG. 2 bearing 10, in association with bearing 9, also locates the nutating parts and constrains their axis 2 to perform the desired nutating motion about axis of revolution 1. In the variant form of FIG. 1 the nutating parts are located and constrained to perform the desired nutating motion by the annular nutating bearing surfaces 12 and 13 rolling on their opposing annular bearing surfaces 14 and 15 respectively and the sliding and/or rolling engagement of peripheral surface 16 with the opposing surface 17 of frame members 7. In the variant form of FIG. 5, nutating motion constraint is provided by the toroidal nutating bearing surface 18 rolling on opposing toroidal bearing surface 19 on frame member 7. In the variant forms of FIGS. 3 and 4, location and nutation constraint of the nutating members are provided by not less than three balls 20 disposed at equal radii about the nutation point 3 each ball being contained by similar matching shaped ball guide cavities 21 and 22 in the spherically shaped nutating member 23 and complementary spherical surface 24 of the frame member 7 respectively in such manner that the balls 20 are able to roll to permit the required movement and to transfer the constraining forces between the nutating and the frame members.

In the variant forms illustrated in FIGS. 2, 3, 4, 6 and 7 a flexible tubular member 25 joins the nutating feed passage 5 to the relatively stationary feed opening 26 and serves to direct the feed material into the grinding chamber and to isolate it from the space occupied by the drive and bearings. In the variant form shown in FIG. 1 the flexible tubular member 25 is replaced by a conical upwardly diverging nutating feed opening 27 which is adapted to receive the feed material from the stationary feed tube 28. In the variant form shown in FIG. 5, flexible tubular member 25 is replaced by a rigid tubular member 29 which is so located in frame 7 that its lower extremity is in sliding engagement with a spherically shaped surface 30 at the entry to nutating feed passage 5. The use of flexible member 25 to join nutating and frame members requires either that it be sufficiently strong to resist the torque arising from the frictional drag of the nutating bearing 10 or that some separate torque resisting device be mounted between the frame and nutating members. Such devices as the constant velocity joint 31 depicted in FIG. 2 or the intermeshing bevel gears 32 illustrated in FIGS. 6 and 7 may be used for this purpose. Torsional restraint is inherent in the ball type location and nutation constraint illustrated in FIGS. 3 and 4. If there is no physical torque restraining mechanism between the frame and nutating members as in the variant forms depicted in FIGS. 1 and 5 torque restraint is provided by frictional resistance to sliding at the rolling contacts between surfaces 12, 13 and 18 and respective opposing surfaces 14, 15 and 19, the very small circumferential difference in length of these opposing surfaces causing a slow rotation of the grinding chamber 4 about its axis of nutation 2 when the mill is operating.

Large centrifugal rotation forces and moments are generated by the nutating motion of the mill and its contained grinding charge and the means employed to oppose or balance such centrifugal effects are of critical importance to the efficient operation of the mill. Whatever the means provided for this purpose it is a primary requirement and important objective of this invention to minimize the nutating mass and to dispose it for least moment about the nutation point 3.

If the mill is to be mounted on and rigidly set and bolted to foundations of mass greatly exceeding the mass of the nutating parts of the mill and firmly set in the ground, the most economic mill construction is to provide for the centrifugal rotating forces and moments to be transmitted via bearings and frame directly to the foundations without providing the mill with dynamic balancing means. Such mill constructions are illustrated in FIGS. 1, 3 and 4.

Figure 5:
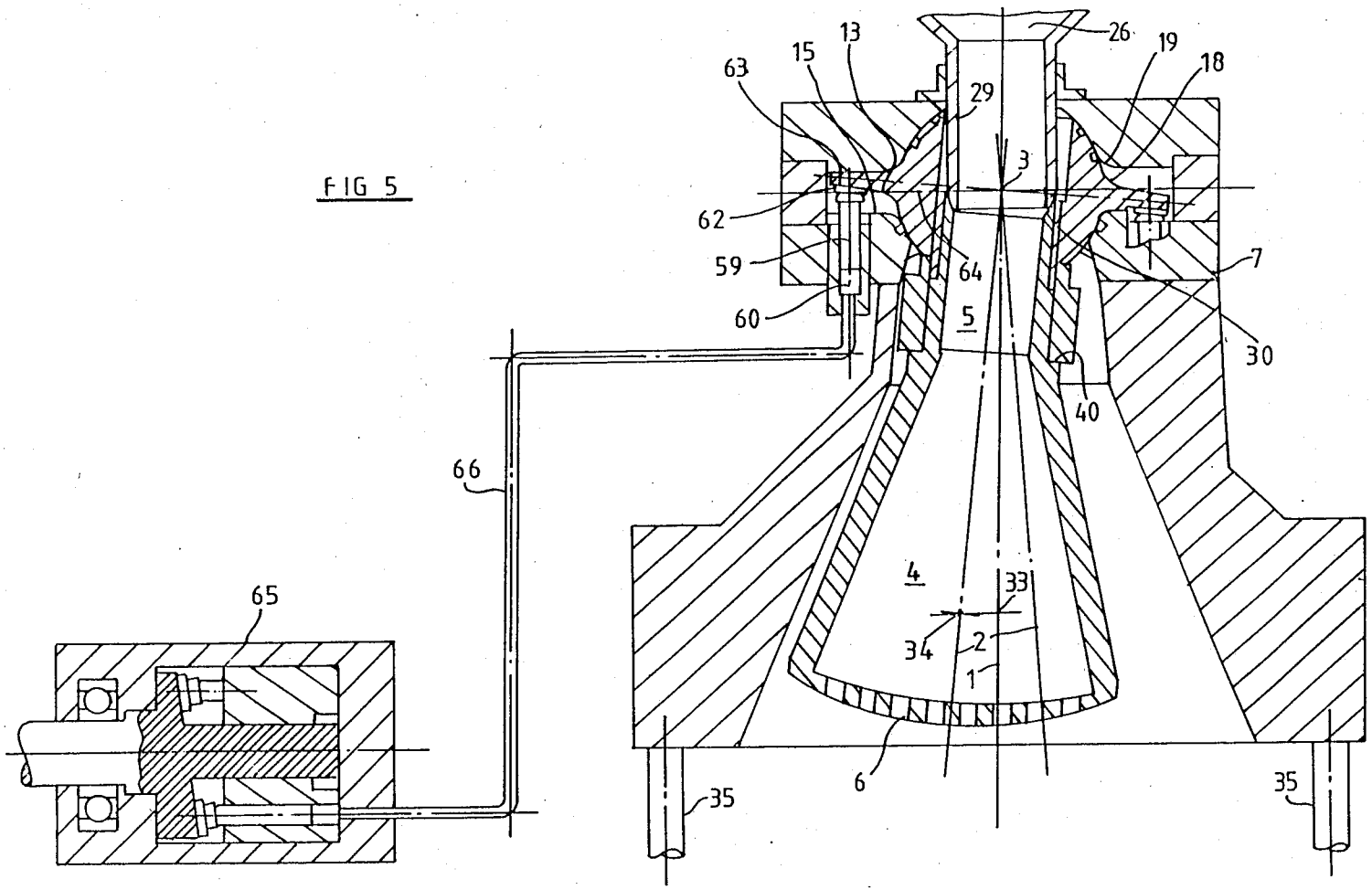
FIG. 5 is a cross-sectional view of a grinding mill formed in accordance with the present invention showing yet another embodiment of this invention.

Alternatively, if the mill is to be mounted on non-rigid supports as illustrated in FIGS. 5, centrifugal forces and moments generated by the nutating parts can be largely counteracted by providing frame members 7 with mass which greatly exceeds the mass of the nutating parts, the centre of mass 33 of said frame members lying on or close to the axis of revolution 1 and the plane of movement of the centre of percussion 34 of the nutating mass. Movement of the mill assembly relative to its foundations as a result of residual centrifugal forces is accommodated by resilient support members 35.

Figure 6:
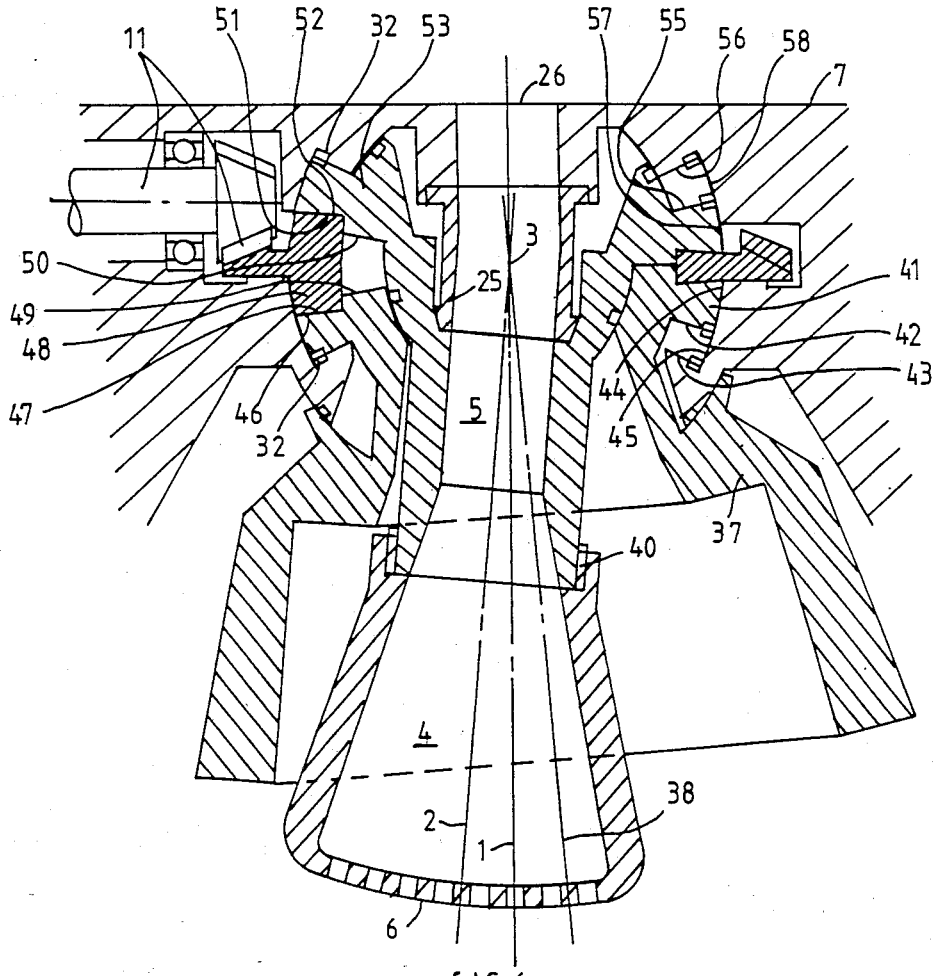
FIG. 6 is a cross-sectional view of an even further embodiment of the grinding mill formed in accordance with the present invention.
Figure 7:
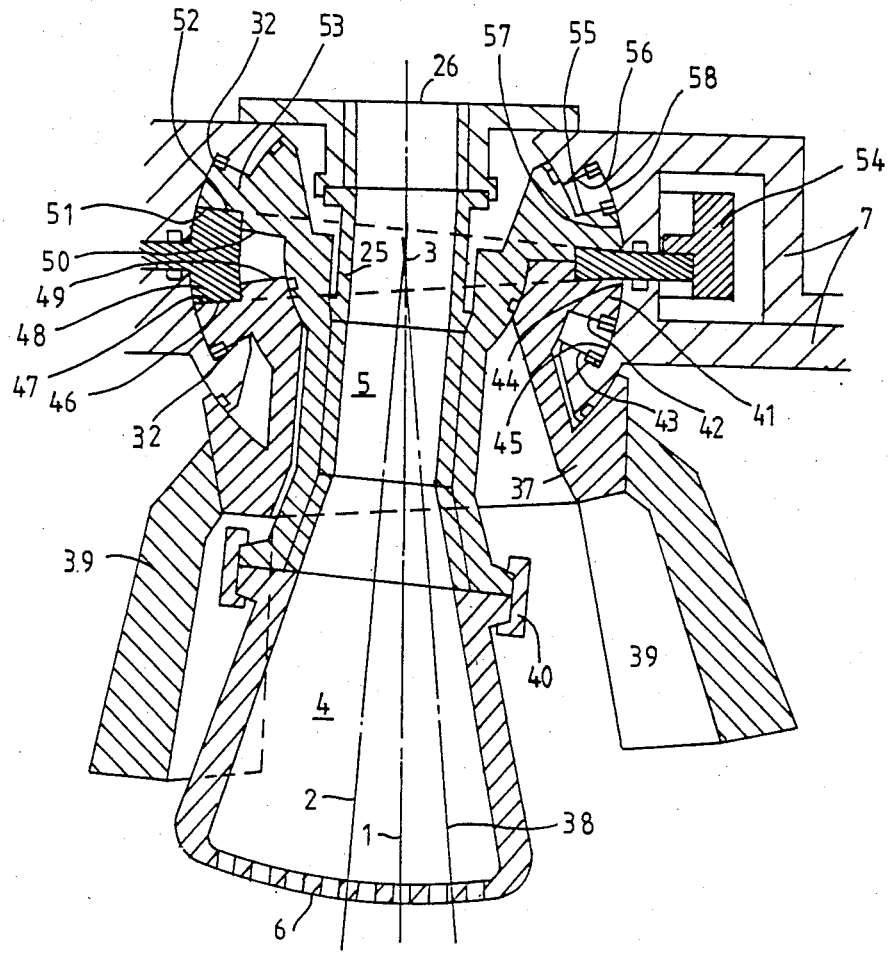
FIG. 7 illustrates an even further embodiment of the invention.

If dynamic balancing is necessary or desirable the option exists for the use of either rotational or nutational means. Rotational balancing means are depicted in FIG. 2 in which bearing 10 so locates the nutating members with respect to the out of balance rotating member 8 that the centre of percussion 34 of the nutating mass and the centre of mass 36 of the members rotating about the axis of revolution 1 lie at such radii on opposite sides of and in a common plane normal to said axis 1 that the centrifugal forces generated by the nutating and rotating masses are substantially equal and opposite and so substantially cancel each other requiring only that bearing 9 transfer to frame member 7 any residual out of balance force or moment component, the gear drive thrust and the gravitational and axial location loading. Alternative nutational dynamic balancing means are depicted in FIGS. 6 and 7 wherein nutating balance member 37 is symmetrically disposed about axis 38 which passes through and nutates about point of nutation 3 on the axis of revolution 1. Nutating balance member 37 is preferably of such proportions that the magnitude and disposition of its mass causes it to have a mass and a radius from nutation point 3 to centre of percussion substantially equal to that of the grinding chamber, its supportive means and its contents. Member 37 may be of continuous annular cross section about axis 38 as depicted in FIG. 6 or, as depicted in FIG. 7, may divide into a plurality of downwardly depending annular segments 39 with spaces between which allow convenient external access to the grinding chamber 4 and its attachment joint 40 for replacement or repair. Nutating balance member 37 is provided with a flange 41 having an annular conical surface 42 with vertex at point of nutation 3 and rolling on opposing frame conical surface 43 and a peripheral spherical surface 44 sliding on opposing spherical frame surface 45. Flange 41 is also provided with an annular plane bearing surface 46 normal to and symmetrical about nutating balancer axis 38 adapted to engage a similar opposing bearing surface 47 on the rotating cam member 48 and with an annular conical surface 49 with vertex at point 3 adapted to roll on similar opposing annular conical nutating surface 50. Rotating cam member 48 is provided with an upper annular plane bearing surface 51 in sliding engagement with a similar opposing nutating bearing surface 52 provided on flange 53 of the nutating assemblage normal to nutating axis 2 so as to cause the desired nutating motion of the members disposed about that axis. Rotating cam 48 is also provided with driving means such as the bevel wheel and counter shaft mounted pinion drive 11 shown in FIG. 6 or the belt driven pulley 54 depicted in FIG. 7. Nutating flange 53 is also provided with annular conical surface 55 with vertex at point 3 and rolling on opposing stationary surface 56 and a peripheral spherical surface 57 sliding on opposing spherical surface 58. The said contacting opposed rolling conical and sliding spherical surfaces serve to determine the opposing nutating motions of the grinding chamber and balancer and to transmit any residual rotating forces and moments to frame member 7.

Figure 4:
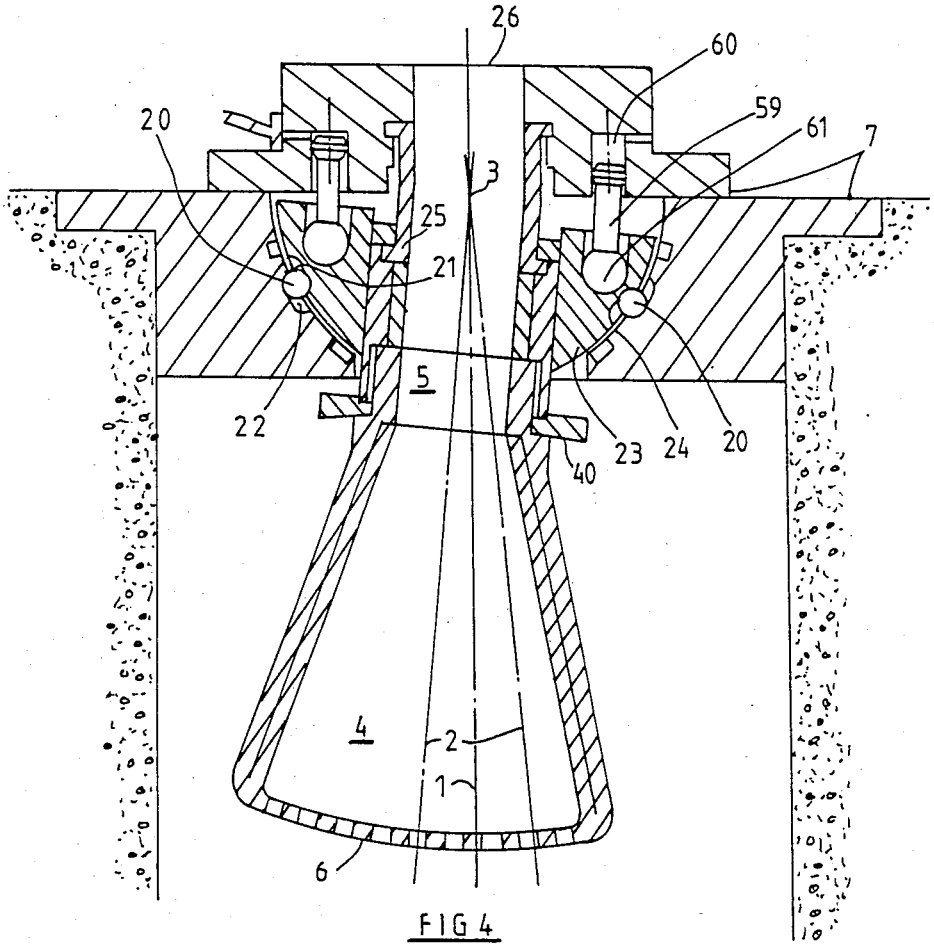
FIG. 4 is a cross-sectional view of a further embodiment of a grinding mill in accordance with the present invention.

FIGS. 4 and 5 illustrate hydraulic driving means comprising not less than three piston member 59 sliding in cylinders 60 in frame member 7. In the variant form of FIG. 4 piston members 59 are self-aligning and connected to nutating member 23 by ball thrust bearings 61. Hydraulic pressure fluid admitted to and discharged from the cylinders in suitable sequence controlled by appropriate valving not illustrated causes member 23 and grinding chamber 4 to have the desired nutating motion the amplitude of which is determined by the supporting balls 20 rolling in the guide cavities 21 and 22. In the variant form of FIG. 5 piston members 59 are provided with self-aligning shoes 62 in contact with an annular plane bearing surface 63 of the nutating flanged member 64. Alternating flow of hydraulic pressure fluid provided by the pump 65 is connected to each of the cylinders 60 in suitable sequence via piping 66, causing member 64 and grinding chamber 4 to perform the desired nutating motion the amplitude of which is determined by the rolling engagement of bearing surfaces 13 and 18 on their respective opposing surfaces 15 and 19 of frame members 7.

Figure 8:
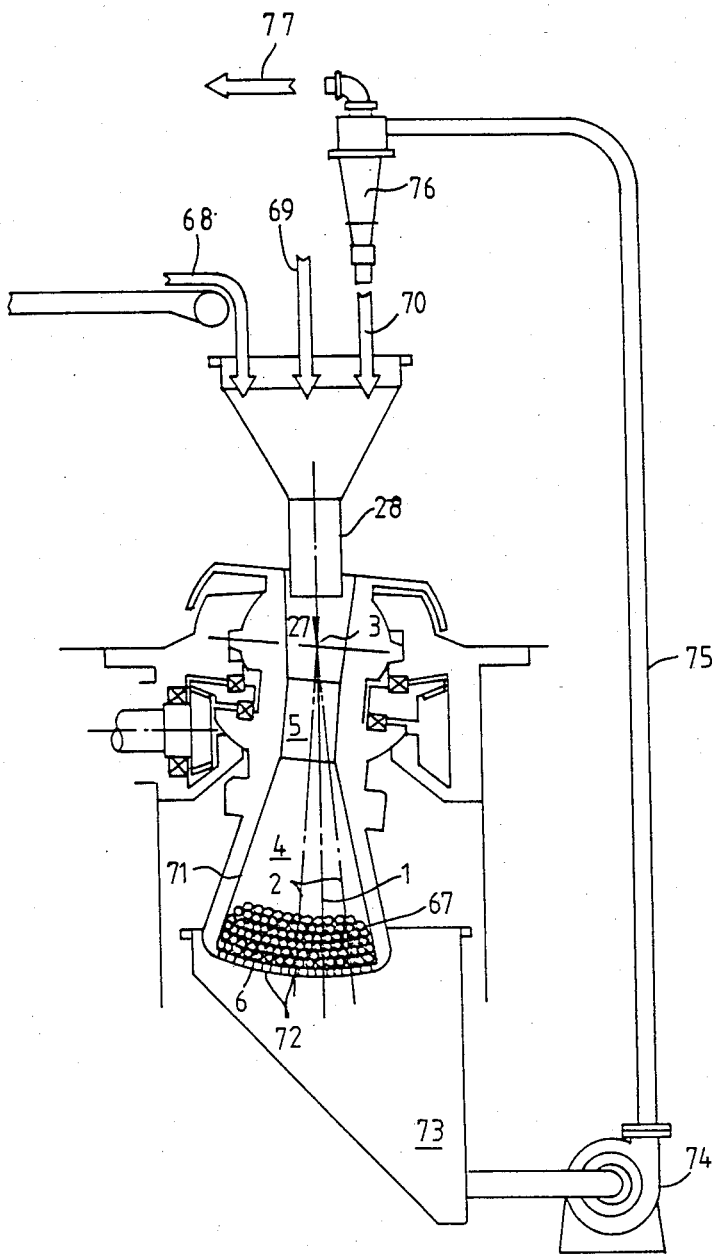
FIG. 8 is a schematic illustration showing an embodiment of the present invention and illustrating a charge of grinding media within the grinding chamber.
Figure 9:
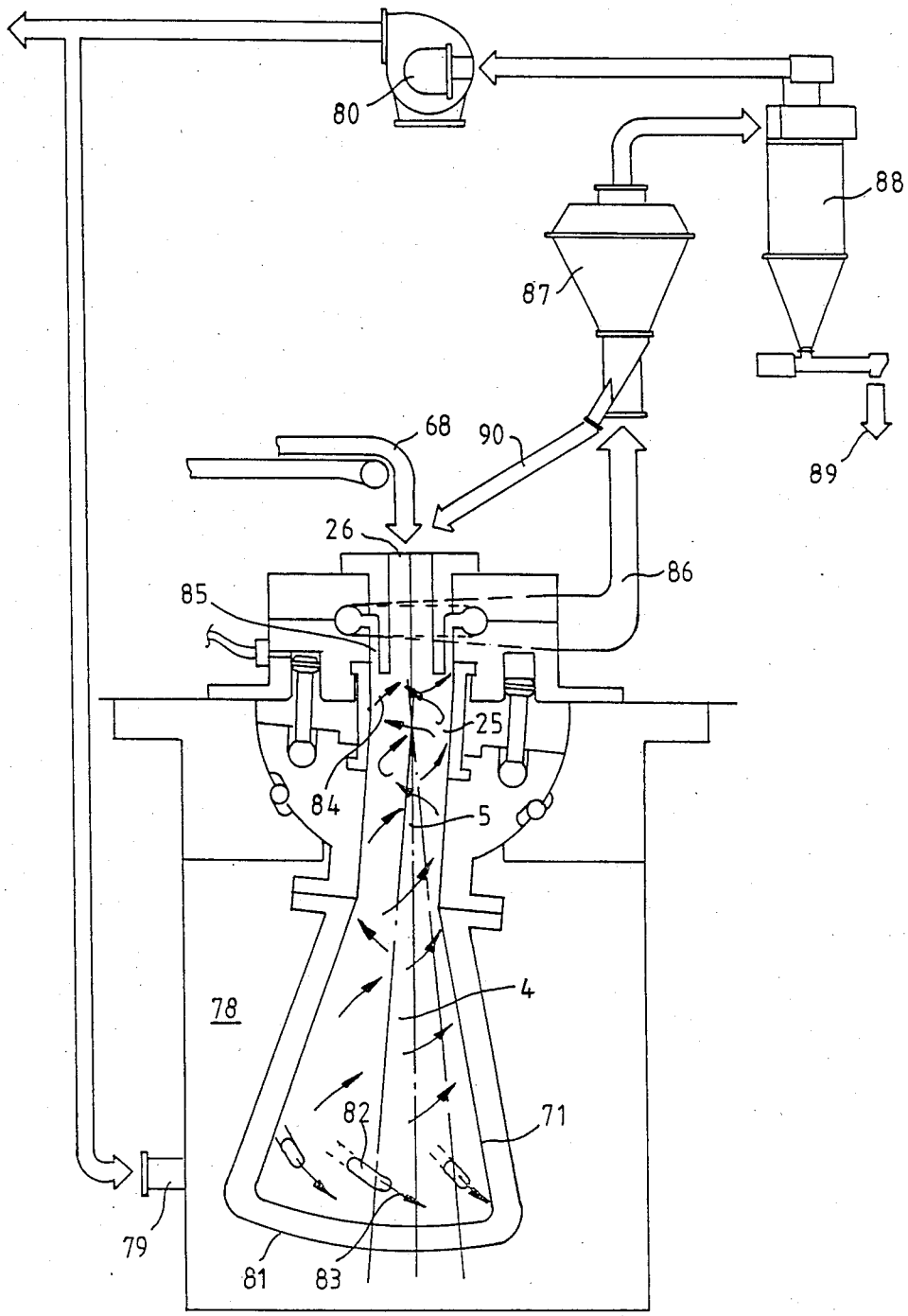
FIG. 9 is a schematic view of another embodiment of the present invention illustrating nutuating motion.

The use and operation of this invention are depicted in FIG. 8 with respect to typical closed circuit wet grinding and in FIG. 9 for typical air separation dry grinding.

Referring to FIG. 8, with a charge of grinding media 67 occupying in bulk approximately 50% of the volume of the grinding chamber 4 when stationary and the mill nutating at the desired speed, particulate solid feed material 68 to be size reduced, water 69 and closed circuit return oversize material 70 are directed to the nutating feed opening 27 by the stationary feed tube 28, enter it by gravity in a substantially vertically downward direction and pass through nutating tubular passage 5 into grinding chamber 4. The flow rates of the above described components entering the grinding chamber are controlled so that the pulp density of the viscosity of slurry and the volume thereof in the grinding chamber are substantially constant and are optimum for promoting grinding efficiency. The effect of the nutating motion of the grinding chamber is to cause its charge to dilate and to perform a tumbling movement substantially normal to the conical sides 71 of the chamber. The inclination of the conical surface 71 of the grinding chamber to the axis of revolution 1 causes the pressure on that surface resulting from the centrifugal force of the charge to have a substantial component directed radially towards the concave grate member 6—so opposing dilation, providing effective containment of the grinding media and promoting the passage of the material being ground through the grinding chamber at a fast rate. The dynamics of the tumbling action and the shape and compactness of the grinding chamber charge collectively promote optimum grinding performance when the ratio of nutation to grinding chamber radii approximates 0.4. When the apex of the conical surface 71 lies close to nutation point 3 the value of said ratio is substantially constant at all grinding chamber cross sections and optimum grinding performance is obtained throughout the active grinding chamber volume. The function of the concave shaped grate member 6 with its apertures 72 is to retain in the grinding chamber all the loose grinding media above a given size and to provide collectively a large area of aperture opening for the rapid discharge of ground material from the grinding chamber. Being at the base of the chamber the discharge grate presents maximum area per unit of effective chamber volume for this purpose. The combination of virtually straight line vertically downward gravity feed to the grinding chamber, the significant downward component of the conical wall reaction to the large centrifugal force acting on the charge and the large grate aperture area for discharge from the grinding chamber enables very high rates of throughput of original feed and circulating components to be achieved, with circulating load ratios of more than twenty to one readily attainable with corresponding benefit.

Ground material discharged from the mill through grate member 6 is collected in a suitable hopper shown diagrammatically at 73, directed therefrom with suitable water dilution to pump 74 and delivered through pipe 75 to a sizing device such as the hydraulic cyclone 76, the overflow 77 of which constitutes the finished product and the underflow 70 the circulating load containing unfinished material which is directed to stationary feed tube 28 and returned to the mill.

Referring to FIG. 9, with the mill nutating at the desired speed and grinding chamber 4 containing a suitable charge of grinding media 67 shown in FIG. 8, substantially dry particulate solid feed material 68 to be size reduced is directed to stationary feed opening 26 to enter flexible tubular member 25 in a substantially vertically downward direction and pass through nutating tubular passage 5 into grinding chamber 4 which is surrounded by an enclosure 78 having a forced air draught admitted through a pipe 79 from a fan 80. The base of grinding chamber 4 is closed by a plate 81, the internal surface of which is concavely profiled and peripherally normal to conical surface 71 of the grinding chamber and said grinding chamber has in the lower section of the conical wall a plurality of apertures 82 being involute and downwardly inclined in the direction of nutating motion, so permitting the ingress of air currents 83 from enclosure 78 into grinding chamber 4.

Under the influence of a decreasing pressure gradient between apertures 82 and tubular passage 5 an upward air current is produced within grinding chamber 4 and by virtue of the internal tumbling action of the dilated media charge when the mill is in motion a vorticity is imparted to the flow of upwardly moving air which sweeps the finer fractions of size reduced solids from grinding chamber 4 into nutating tubular passage 5, in countercurrent flow to the downwardly moving coarse particulate feed 68. The air stream 84 laden with particulate ground material is withdrawn via the annular flow passage 85 by indirect suction from fan 80 and is directed via pipe 86 to a suitable sizing device such as the air classifier at 87, the fine fraction from which is typically recovered from the air stream by a cyclone collector 88 and constitutes finished product 89. The coarse fraction 90 of unfinished material is directed to feed opening 26 and so returned to the mill.

The use and operation of a grinding mill are enhanced and facilitated if those parts subjected to abrasive wear in the grinding process are readily accessible and capable of easy and quick removal and replacement. The location of the grinding chamber externally to the separately contained and sealed driving and support means and the provision of external effective means for removably attaching it to the nutating feed passage 5, variously depicted at 40 as a bolted flange joint in FIG. 3, a clamped flange joint in FIGS. 1 and 7, a screwed and shouldered joint in FIG. 6, a screwed, shouldered and wedged joint in FIG. 4 and a screwed, shouldered and compression sleeved joint in FIG. 5 fully satisfy such criteria and are important features of this invention.

We claim:

1. A centrifugal grinding mill comprising:

(a) a grinding chamber of substantially circular cross-section with respect to an axis of symmetry and constrained to have nutating motion about a relatively stationary axis, said axis of symmetry and said relatively stationary axis intersecting at a point of nutation symmetry;

(b) support means for supporting said grinding chamber;

(c) a feed passage in communication with and directed towards said grinding chamber;

(d) driving means for driving said grinding chamber about said relatively stationary axis; and (e) constraint means for determining the form of nutating motion of said axis of symmetry of said grinding chamber;

(f) said grinding chamber being adapted to carry a grinding charge, said point of nutation symmetry being disposed relative to said grinding chamber so that nutating motion of said grinding chamber during operation of the grinding mill causes said grinding charge to dilate and to perform a tumbling motion within said grinding chamber, said grinding chamber having an inner surface configured to exert pressure on said grinding charge limiting its dilation and providing effective containment thereof, said surface exerting pressure on said grinding charge in a direction away from said point of nutation symmetry.

2. A centrifugal grinding mill according to claim 1, wherein said relatively stationary axis is substantially vertical and said feed passage is downwardly directed towards said grinding chamber.

3. A centrifugal grinding mill according to claim 2, wherein said feed passage is upwardly divergent and adapted to receive feed material from a separate stationary feed tube.

4. A centrifugal grinding mill according to claim 1, wherein said surface of said grinding chamber exerting pressure on said grinding charge limiting its dilation and providing effective containment thereof is substantially frusto-conical in shape with its geometrical vertex in the vicinity of said point of nutation symmetry.

5. A centrifugal grinding mill according to claim 1, wherein the end of said grinding chamber furtherest from said feed passage defines openings for the discharge of ground material from said grinding chamber.

6. A centrifugal grinding mill according to claim 5, wherein the internal surface of the discharge end of said grinding chamber is concave with a centre of curvature in the vicinity of the geometrical vertex of the chamber.

7. A centrifugal grinding mill according to claim 1, wherein said feed passage includes a flexible section and is adapted to provide a fluid tight connection between a stationary tube and said grinding chamber.

8. A centrifugal grinding mill according to claim 1, wherein said feed passage includes a rigid stationary tube having sliding sealing engagement with a second part of said feed passage in the form of spherical surfaces centred on the point of nutation symmetry.

9. A centrifugal grinding mill according to claim 1, wherein rotation of said grinding chamber about said axis of symmetry is prevented by torque restraint means connecting said grinding chamber to said supporting means.

10. A centrifugal grinding mill according to claim 1, wherein said driving means comprises mechanically driven means mounted in said support means for rotation about said relatively stationary axis and provided with a bearing co-axial with said axis of nutating motion and adapted to drive said grinding chamber.

11. A centrifugal grinding mill according to claim 10, wherein the mass of said driven means and the location of the centre thereof are such that the centrifugal forces and moments generated by the respective nutating and rotating masses are substantially self balancing.

12. A centrifugal grinding mill according to claim 1, wherein said driving means comprise a set of hydraulic cylinder and piston assemblies symmetrically disposed about the point of nutation symmetry and sequentially actuated to cause the desired nutating motion.

13. A centrifugal grinding mill according to claim 12, wherein said hydraulic cylinder and piston assemblies are sequentially actuated by means of an alternating hydraulic pump.

14. A centrifugal grinding mill according to claim 1, wherein said constraint means comprise annular bearing surfaces associated with said grinding chamber and engaging complementary opposing bearing surfaces on said support means, said bearing surfaces providing a spherical bearing symmetrical about and defining the nutation centre and a bearing symmetrical about said axis of nutating motion having rolling and sliding movement between its opposing surfaces and adapted to limit the amplitude of the nutating movement.

15. A centrifugal grinding mill according to claim 1, wherein centrifugal forces and moments arising from the nutating motion are substantially offset by the mass of said support means and the disposition thereof.

16. A centrifugal grinding mill according to claim 1, wherein centrifugal forces and moments arising from the nutating motion are substantially balanced by a balance mass having opposing nutating motion.

17. A centrifugal grinding mill according to claim 1, wherein said grinding chamber defines openings for the admission of gas thereto so that substantially dry feed may be ground in said grinding chamber, said openings being positioned and directed so as to cause the admitted gas to mingle with and sweep the grinding charge and to convey ground material counter to the entering feed to a passage for facilitating its discharge separately from the entering feed material.

18. A centrifugal grinding mill according to claim 1, wherein said grinding chamber is attached to said feed passage by a joint which facilitates its easy and quick removal and replacement.

19. A grinding chamber member for use in a centrifugal grinding mill having a feed passage for feeding material to be ground, said grinding chamber member having:

a substantially circular cross-section with respect to an axis of symmetry, means thereon for releasable attachment to said grinding mill so as to be in communication with and circumferentially encompassing said feed passage, said means for releasable attachment being disposed so that said axis of symmetry in operation is constrained to have nutating motion about a relatively stationary axis, said axis of symmetry and said relatively stationary axis intersecting at a point of nutation symmetry, said point of nutation symmetry being disposed so that nutating motion of the grinding chamber during operation of the grinding mill causes a grinding charge within the chamber to dilate and perform a tumbling motion within the grinding chamber, and an inner surface configured to exert pressure on the grinding charge limiting its dilation and providing effective containment thereof, said surface exerting pressure on said grinding charge in a direction away from said point of nutation symmetry.

20. A method of grinding solid particles comprising the steps of:

providing a grinding chamber of substantially circular cross-section with respect to an axis of symmetry.

providing a discharge end defining openings therein on said grinding chamber, providing a charge of grinding media in said grinding chamber, supporting said grinding chamber in a grinding mill, operatively coupling a feed passage to one end of said grinding chamber remote from the discharge end of said grinding chamber, introducing the solid particles to be ground through said feed passage into said grinding chamber, imparting nutation motion to said grinding chamber about a relatively stationary axis so as to cause a grinding action within said grinding chamber, said axis of symmetry and said relatively stationary axis intersecting at a point of nutation symmetry.

exerting pressure on the grinding media in a direction away from said point of nutation symmetry to limit the dilation of and to effectively contain the grinding media, and recovering ground particles discharged through said openings.

21. A method of grinding solid particles comprising the steps of:

providing a grinding chamber of substantially circular cross-section with respect to an axis of symmetry, defining an opening in said grinding chamber for admitting fluid to said grinding chamber, providing a charge of grinding media in said grinding chamber, introducing the solid particles to be ground into said grinding chamber, imparting nutating motion to said grinding chamber about a relatively stationary axis so as to cause a grinding action within said grinding chamber, said axis of symmetry and said relatively stationary axis intersecting at a point of nutation symmetry, exerting pressure on the grinding media in a direction away from said point of nutation symmetry to the limit the dilation of and to effectively contain the grinding media, admitting fluid through said opening to sweep said grinding chamber and to convey ground particles in a direction counter to said particles being introduced into said grinding chamber, and recovering ground particles conveyed by the fluid.

* * * * *